US005575710A

United States Patent [19]

Kramer

[11] Patent Number: 5,575,710

[45] Date of Patent: Nov. 19, 1996

[54] LEVELING MECHANISM FOR FLOOR SANDERS

[75] Inventor: Michael G. Kramer, Springdale, Ark.

[73] Assignee: Clarke Industries, Inc., Springdale, Ark.

[21] Appl. No.: 550,619

[22] Filed: Oct. 31, 1995

[51] Int. Cl.[6] ..... B24B 23/00

[52] U.S. Cl. ..... 451/350; 451/355; 451/296

[58] Field of Search ..... 451/350, 354, 451/355, 297, 296, 360, 361, 310

[56] References Cited

U.S. PATENT DOCUMENTS

| | | | |
|---|---|---|---|
| 2,277,236 | 3/1942 | Kneisley et al. . | |
| 2,497,791 | 2/1950 | Peterson . | |
| 2,598,080 | 5/1952 | Swalinkavich | 451/350 |
| 3,422,579 | 1/1969 | Rogge et al. . | |
| 3,664,393 | 5/1972 | McLeod et al. . | |
| 5,287,660 | 2/1994 | Bellati et al. . | |
| 5,341,605 | 8/1994 | Tasikas . | |

OTHER PUBLICATIONS

Sketch showing a prior art design referred to on page 3 of the above–referenced application.

Instructions for care and operation, Parts List for Clarke Model 504 Drum Sander.

Sales Brochure for Galaxy Model 506 Floor Sander.

Clarke's American 8 Floor Sander Owner's Manual; dated Apr. 1994;pp. 13, 22 and 23.

Sales Brochure for Clarke American Sanders; dated Aug. 1993; entire brochure.

*Primary Examiner*—D. S. Meislin
*Assistant Examiner*—George Nguyen
*Attorney, Agent, or Firm*—Senniger, Powers, Leavitt & Roedel

[57] ABSTRACT

This invention is directed to a floor sander comprising a frame on wheels, a chassis carried by the frame, and a motor-driven sanding head mounted on the chassis generally adjacent the front of the chassis for rotation about an axis extending in side-to-side direction with respect to the chassis. The chassis is mounted on a pivot shaft extending in side-to-side direction with respect to the frame so that the sanding head can be raised and lowered relative to a surface to be sanded. The pivot shaft has first and second bearing assemblies at its ends. A first side of the chassis is movable up and down relative to the first bearing assembly, and a second side of the chassis is secured against up and down movement relative to the second bearing assembly. A guide system is provided for controlling the up and down movement of the first side of the chassis relative to the first bearing assembly so that the movement is in a vertical direction. A leveling mechanism can be operated to effect vertical movement of the first side of the chassis relative to the first bearing assembly and with respect to the second side of the chassis thereby to adjust the attitude of the chassis to position the axis of rotation of the sanding head in a plane common with an axis of rotation of the wheels on the frame.

11 Claims, 7 Drawing Sheets

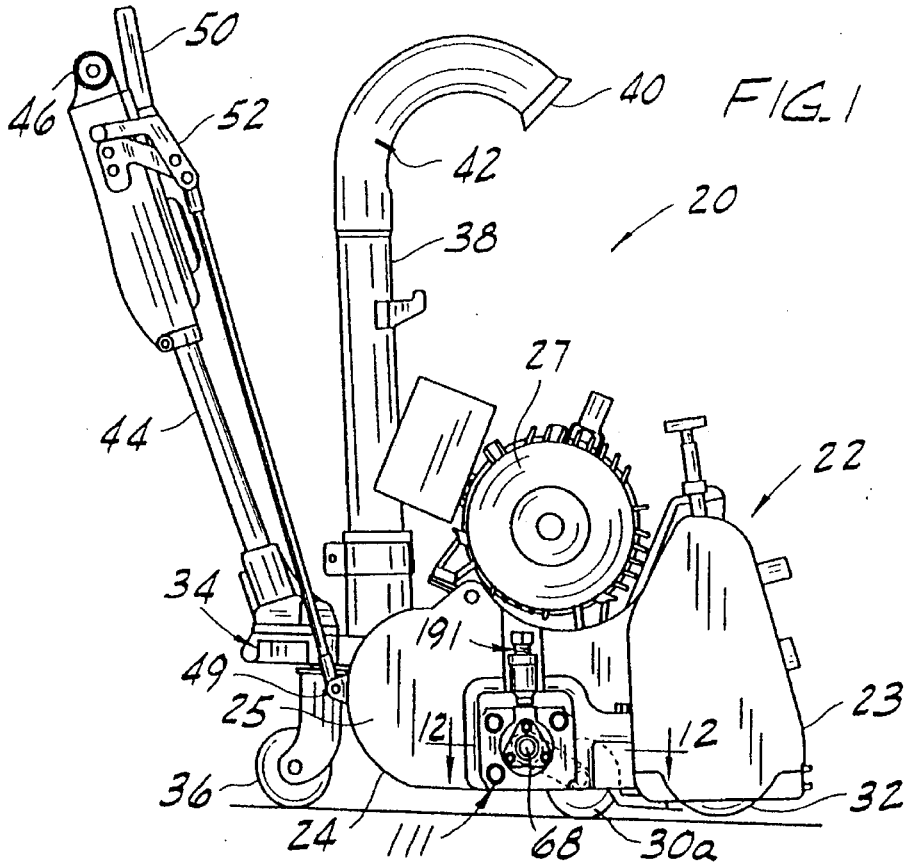
FIG. 1
FIG. 3
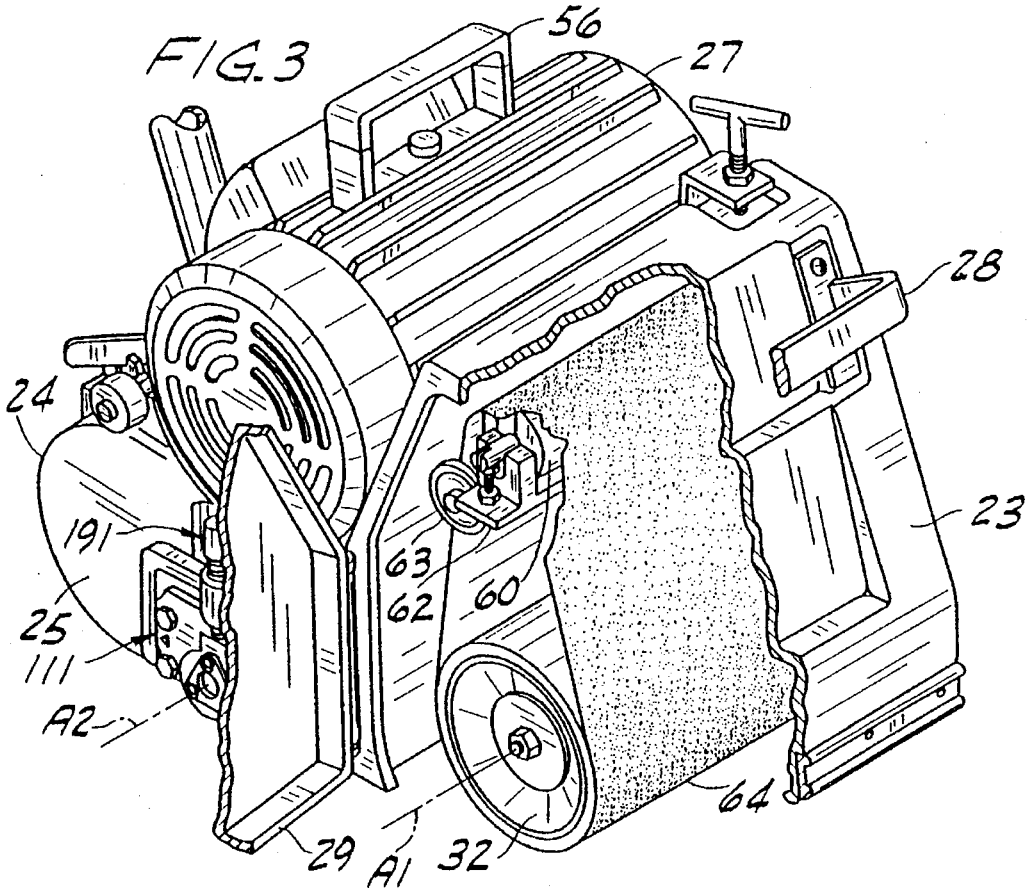

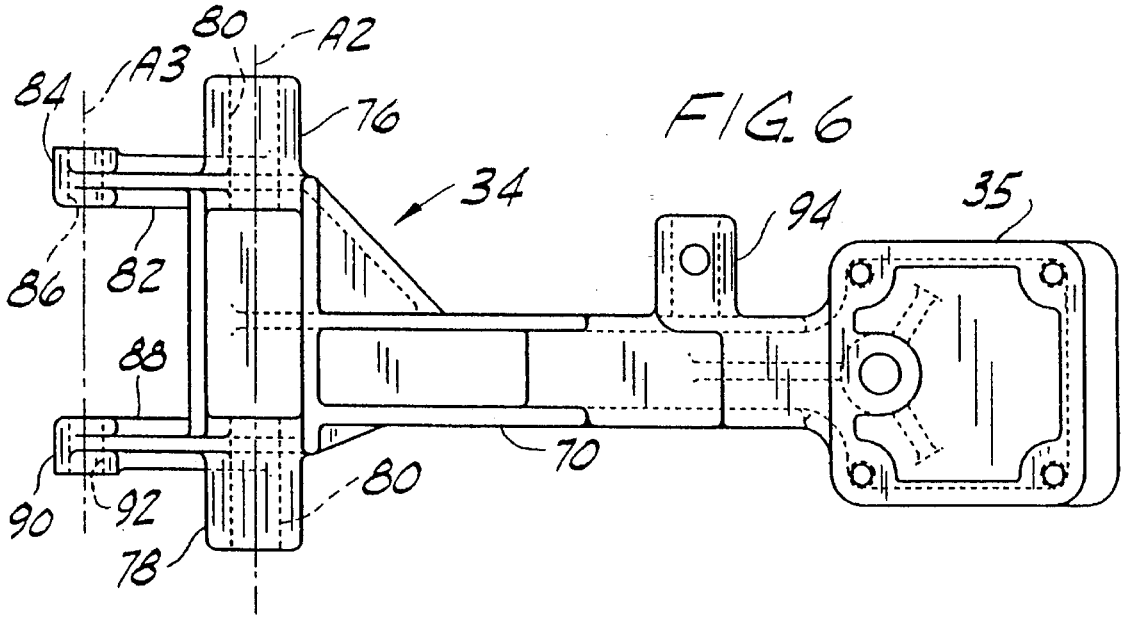
FIG. 6
FIG. 7
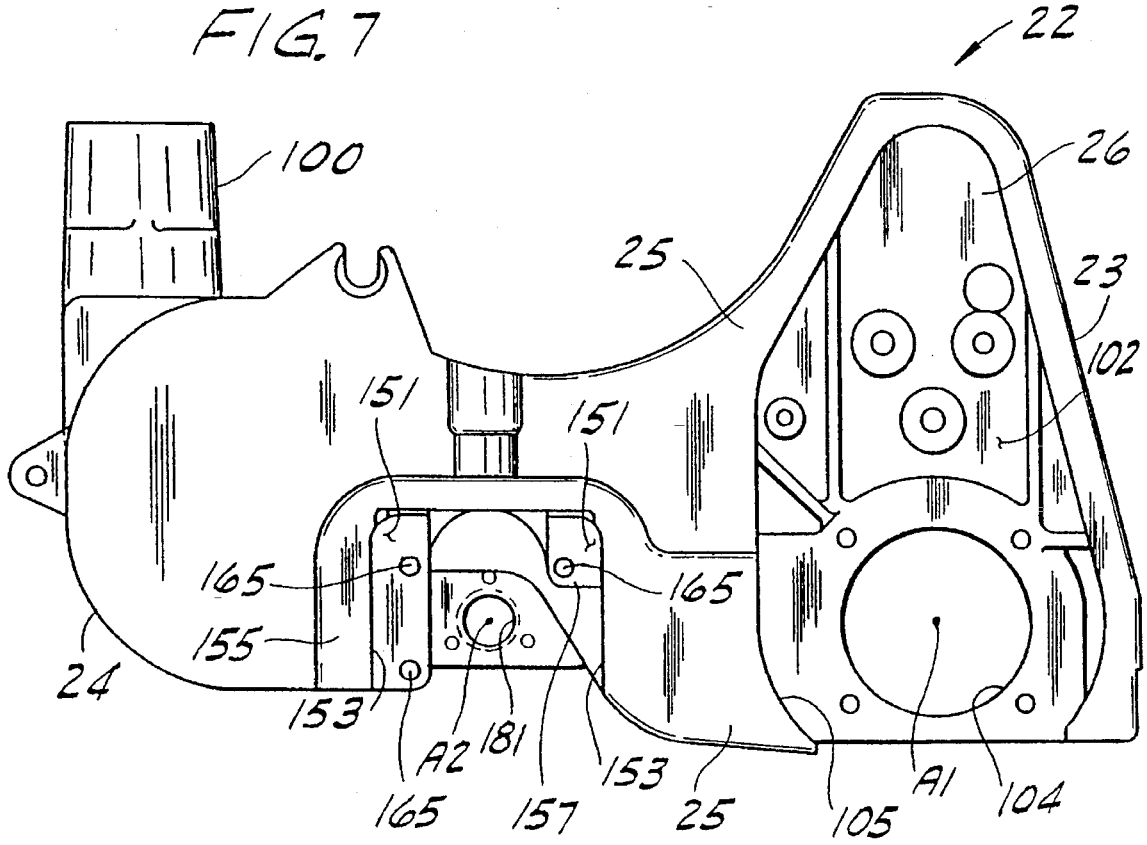

LEVELING MECHANISM FOR FLOOR SANDERS

FIELD OF THE INVENTION

The present invention relates generally to sanding machines or sanders and, more particularly to portable floor sanders.

BACKGROUND OF THE INVENTION

Portable motorized floor sanders for resurfacing wood floors and the like have been known for many years. These sanders typically include a frame, two or more wheels on the frame, sometimes including a caster wheel, a sanding head which is carried by a chassis mounted on the frame, and a motor for rotating the sanding head to sand the floor. In some sanders the chassis is pivoted on the frame so that the sanding head can be pivoted up and down relative to the surface to be sanded.

Generally, there are two types of portable floor sanders, drum sanders and continuous belt sanders. In a drum sander an abrasive such as sandpaper is secured to the drum which is rotated by a motor. As the drum rotates, the sandpaper rotatably contacts the surface of the floor to effect the sanding operation. In a continuous belt sander, a continuous loop or "belt" of an abrasive such as sandpaper is trained around a drum, known as the contact wheel, and a tracking roller. A tracking and release mechanism maintains the abrasive belt aligned on the contact wheel. The contact wheel is typically driven by a motor and V-belt arrangement. The present invention is applicable to both types of sanders, that is, to drum sanders and to continuous belt sanders. To obtain a smooth, level finish, it is important that the sanding head (whether it be the drum of a drum sander or the contact wheel of a continuous belt sander) remain "level" with respect to the wheels of the sander. In other words, it is important that the axis of rotation of the sanding head be coplanar with the axis of the wheels of the sander. If these axes are not maintained coplanar (i.e., if the sanding head is skewed vertically with respect to the axis of the wheels), forces are generated which tend to cause non-uniform sanding along the head of the sander. Moreover, such forces tend to produce a sideward drag on the sander, causing it to pull sideways rather then track straight ahead, and further causing uneven wheel wear. In a continuous belt sander, these forces also place undue strain on the tracking device holding the belt aligned on the head. There are some situations when it is desirable that the axes of rotation of the sanding wheel and the truck wheels not be parallel. However, this is the exception rather than the rule.

In the prior art, various schemes have been developed to maintain the sanding head "level" with respect to the wheels of the sander. For example, in one prior design a pivot shaft is mounted on the frame of the sander, and a chassis carrying the sanding head is mounted on the pivot shaft for pivotal movement relative to the frame to raise and lower the sanding head. An eccentric on one end of the pivot shaft is used to cant the chassis until the axis of the sanding head is coplanar with the axis of the wheels.

In another prior design, the sanding head is mounted for rotation on the chassis by two suspension arms. Leveling of the head is accomplished by raising one arm relative to the other arm.

However, these and other prior leveling mechanisms suffer substantial drawbacks. Some prior designs cause skewing of the sanding head relative to the direction of movement of the sander, which causes the sander to track sideways instead of straight ahead as it moves forward. Some cause uneven loading of the sanding head along the length of the head, which results in an uneven surface finish. Some cause misalignment of the drive components and diminish rigidity of the sanding head, which causes periodic vibration and chatter of the sander as it moves across the floor. In short, prior leveling mechanisms have diminished the quality of sanding performance and/or placed undue stress on components of the sander. This is especially true in the case of continuous belt sanders.

There is a need, therefore, for an improved leveling mechanism which can be used on portable sanders and which is operable to maintain the sanding head generally parallel or "level" with the axis of rotation of the wheels of the sander, without suffering the disadvantages associated with the prior designs.

SUMMARY OF THE INVENTION

Among the several objects of this invention may be noted the provision of a portable sander having an improved leveling mechanism for maintaining the axis of the sanding head of the sander generally coplanar with the axis of the truck wheels supporting the sander; the provision of such a sander having a leveling mechanism which maintains the sanding head level as the sander rides over high and low areas of a surface being sanded, thus providing a more uniform surface finish; the provision of such a sander and a leveling mechanism which minimizes edge wear on the truck wheels and trailing caster wheel of the sander; the provision of such a sander and leveling mechanism in which swivelling movement of the caster wheel has no significant affect on the sanding pressure exerted by the sanding head; the provision of such a sander and leveling mechanism in which forces exerted on the handle of the sander have no significant affect on the sanding pressure exerted by the sanding head; the provision of such a sander having a leveling mechanism which does not cause bucking or other instability of the caster wheel; the provision of such a sander having leveling mechanism which does not cause misalignment of the drive belt relative to the sanding head; the provision of such a sander having a leveling mechanism which does not introduce a sideward drag on the abrasive; and the provision of such a sander having a leveling mechanism which is easy to use and reliable in operation.

Generally, a floor sander of this invention comprises a frame on wheels, at least one of the wheels being rotatable about a wheel axis extending in side-to-side direction with respect to the frame. The sander also includes a chassis carried by the frame. The chassis has a front, a back, a first side, and a second side opposite the first side. A motor-driven sanding head is mounted on the chassis generally adjacent the front of the chassis for rotation about an axis extending in side-to-side direction with respect to the chassis. A pivot shaft is mounted on the frame and extends in side-to-side direction with respect to the frame. The chassis is pivotable on the pivot shaft to raise and lower the sanding head relative to a surface to be sanded. A first bearing assembly is mounted on a first end of the pivot shaft adjacent the first side of the chassis, the first side of the chassis being movable up and down relative to the first bearing assembly. A guide means controls this up and down movement so that it is in a vertical direction. A second bearing assembly is mounted on a second end of the pivot shaft, the second side of the chassis being secured in substantially fixed vertical position with respect to the second bearing assembly. A leveling means is operable to effect vertical movement of the first side of the chassis relative to the first bearing assembly and with respect to the second side of the chassis thereby to adjust the attitude of the chassis to position the axis of rotation of the sanding head in a plane common with the wheel axis.

In accordance with another aspect of the present invention, the sander includes three truck wheels. Two of the truck wheels are coaxially disposed on one side of the chassis with the third wheel disposed on the opposite side. This adds greater stability to the sander and enhances the ability of the sander to produce a flat sanded finish of uniform qualtity.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings.

It is noted, however, that the appended drawings illustrate only a typical embodiment of this invention and are not to be considered limiting of its scope, for the invention may admit to other equally effective embodiments. The appended drawings may be described as follows:

FIG. 1 is a side elevation of a portable, continuous belt floor sander embodying the present invention;

FIG. 3 is an enlarged perspective of a portion of the sander of FIG. 1, parts being broken away to show an abrasive belt of sandpaper mounted on the sander;

FIG. 6 is a top plan of the truck frame;

FIG. 7 is a side elevation of the sander chassis;

Corresponding parts are designated by corresponding reference numbers throughout the several views of the drawings.

DETAILED DESCRIPTION OF THE PREFERRED EMBODIMENT

Figure 4:
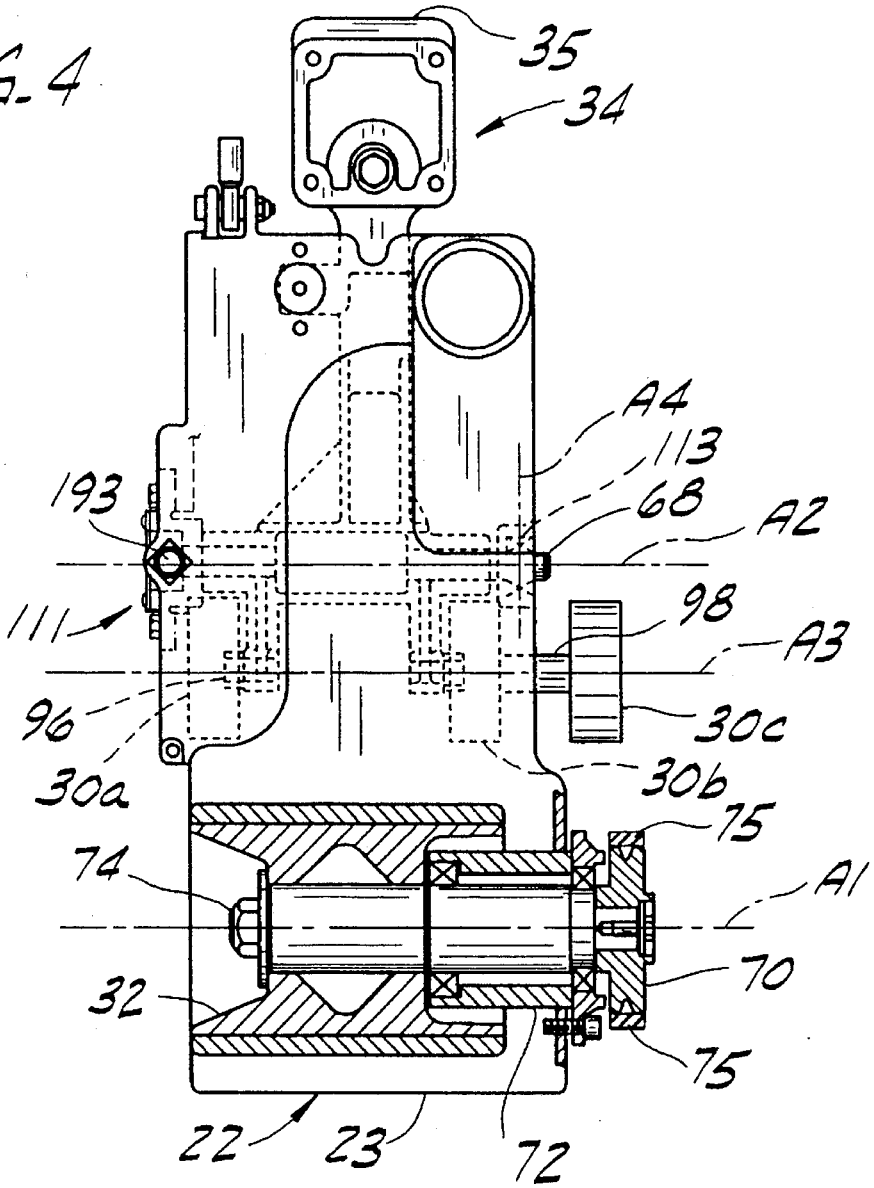
FIG. 4 is a top elevation of the truck frame and chassis of the floor sander of FIG. 1, the contact wheel and a pulley connection being shown in section for clarity.
Figures 13, 13A:
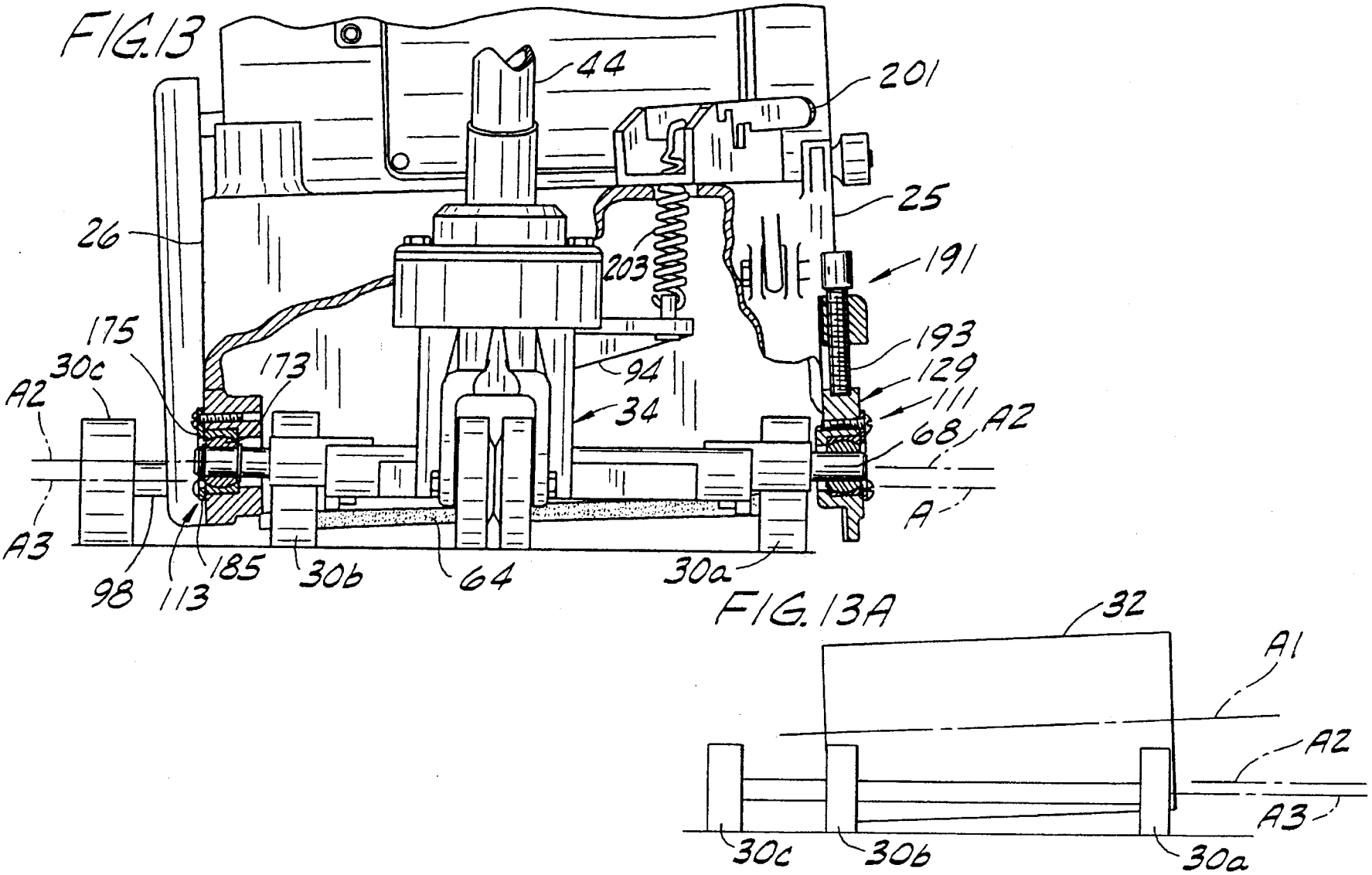
FIG. 13 is a partial rear elevation of the sander of FIG. 1 with some parts broken away and other parts in section to show the leveling mechanism adjusted so that the contact wheel is inclined in one direction with respect to the floor.
FIG. 13A is a schematic view of FIG. 13 showing the relative orientations between the axis of the contact wheel, the axis of the pivot shaft and the axis of the frame wheels.
Figures 14, 14A:
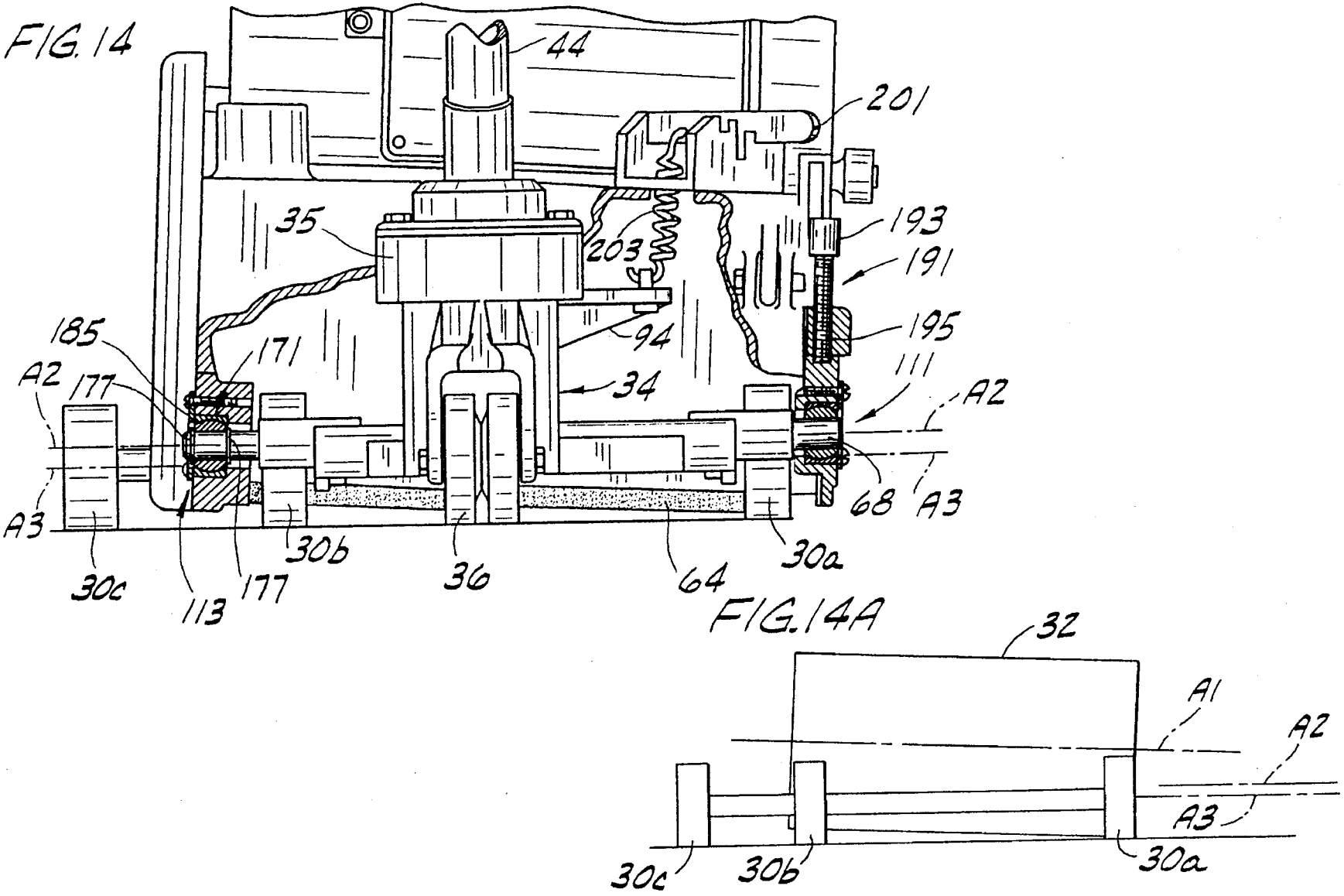
FIG. 14 is a view similar to FIG. 13 showing the leveling mechanism adjusted so that the contact wheel is inclined in an opposite direction with respect to the floor.
FIG. 14A is a schematic view of FIG. 14 showing the relative positions between the axis of the contact wheel, the axis of the pivot shaft and the axis of the frame wheels.

Referring now to FIG. 1, a portable floor sander of the present invention is indicated in its entirety by the reference numeral 20. The floor sander 20 is a continuous belt type sander, and it includes a chassis, generally indicated at 22, having a front 23, a back 24, a first side 25 and a second side 26 opposite the first side. The chassis supports a motor 27 for propelling the sander 20 and driving the abrasive. The motor 27 has a carrying handle 56, and the chassis also includes a carrying handle 28 (FIG. 3). The chassis 22 is pivotally supported on a frame (commonly known as a "truck frame") indicated generally at 34. The truck frame 34 is movably carried by and supported on three truck wheels 30*a*, 30*b*, and 30*c*, all of which are best seen in FIGS. 4, 13, and 14. The truck frame 34 is also supported adjacent its rearward end by a caster assembly 36 that is swivelable 360°. By having the caster assembly 36 attached to the truck frame 34 rather than to the chassis, caster buck is reduced. The chassis 22 also supports a rotatable sanding head 32, which is known in the trade as a contact wheel in a continuous belt sander. The contact wheel 32 is rotatable about an axis A1 which extends in side-to-side direction with respect to the chassis (see FIG. 4).

As best seen in FIG. 3, a door 29 is hingedly attached to the first side 25 of the chassis 22 so that it may be swung open to access the contact wheel 32. A carriage 62 is mounted within the chassis 22 above the contact wheel and rotatably supports a tracking roller 60 and guide wheels 63 (only one guide wheel is shown in FIG. 3). A continuous loop or belt 64 of abrasive, such as sandpaper, extends around the tracking roller 60 and the contact wheel 32. The tracking wheel 63 acts on the carriage in a way to maintain the abrasive belt 64 properly aligned with respect to the contact wheel 32. The abrasive belt 64 is accessible for replacement by opening the door 29.

Referring to FIG. 4, the contact wheel 32 is mounted on a shaft and bearing assembly 72 via a fastening system 74. A pulley 70 on one end of the shaft is connected by a belt 75 to a pulley (not shown) that is coupled to the motor 24. As the motor pulley rotates, the belt rotates the contact wheel pulley 70 to rotate the contact wheel 32 and thus the abrasive belt 64. The position of the tracking roller 60 is adjustable to maintain tension in the abrasive belt 64.

Figure 2:
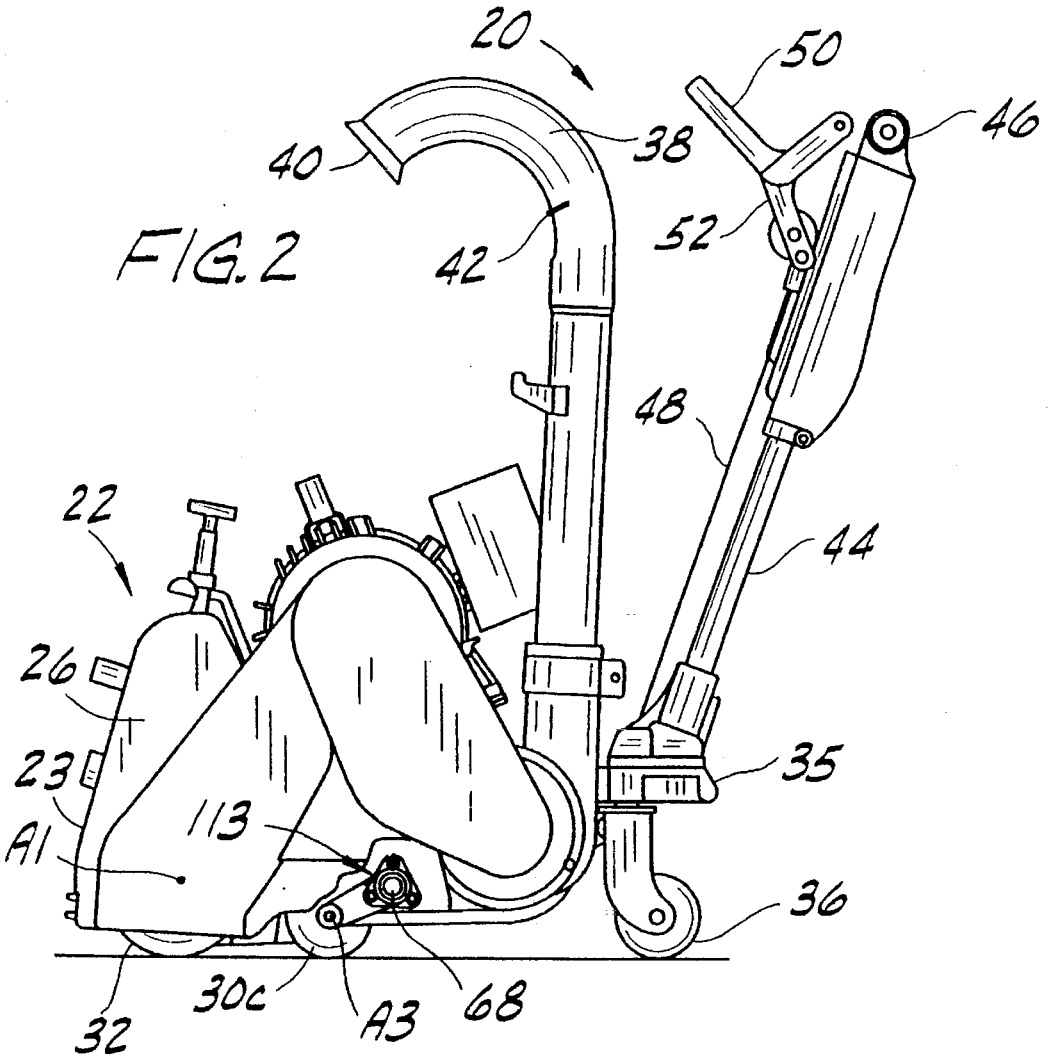
FIG. 2 is an opposite side elevation of the floor sander, parts of the chassis being broken away to show details of a bearing assembly.

The sander 20 also includes an exhaust tube 38 that terminates in an exhaust outlet 40 which communicates with a collection bag (not shown) for collecting dust resulting from the sanding process. The exhaust tube 38 includes a bag hook 42 for supporting the collection bag. Extending upwardly from a rear platform 35 of the truck frame is a handle shaft 44 that terminates in a handle 46. The handle shaft 44 also serves to support a control rod 48 that is coupled to the chassis 22 for pivotally raising and lowering the contact wheel 32 relative to the floor. The control rod 48 is pinned at its lower end to a lug 49 on the back 24 of the chassis 22. The upper end of the control rod is pinned to a control lever 50 which is supported by a bracket 52 on the handle shaft 44, the arrangement being such that the control lever 50 may be moved to pivot the chassis 22 on the truck frame 34 between a sanding position (FIG. 2) in which contact wheel 32 engages the floor and a non-sanding position (FIG. 1) in which the contact wheel is raised above floor.

Figure 5:
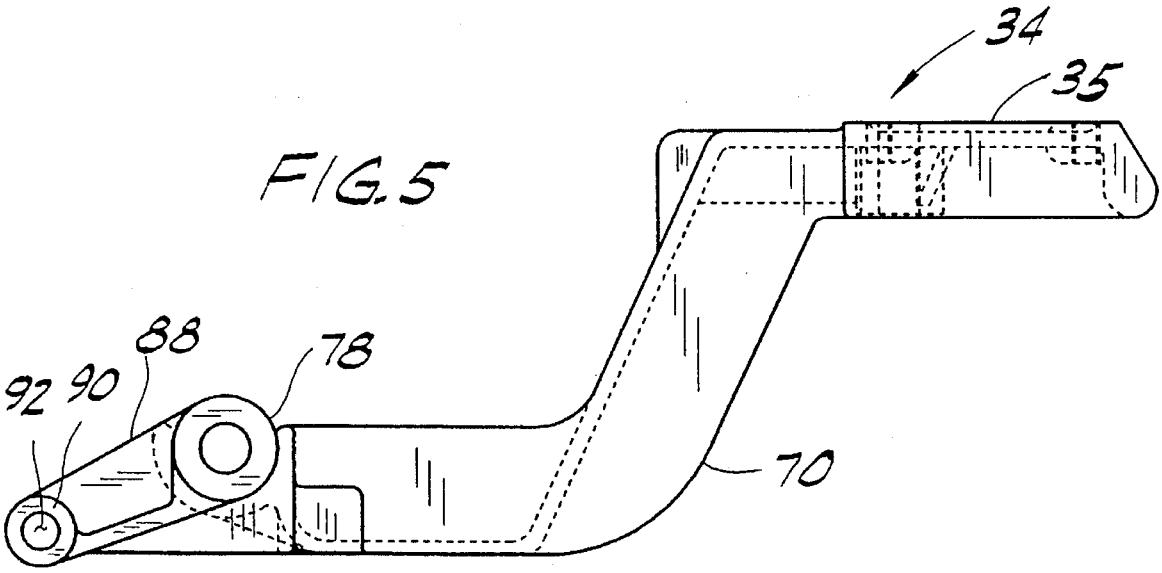
FIG. 5 is a side elevation of the truck frame.
Figure 8:
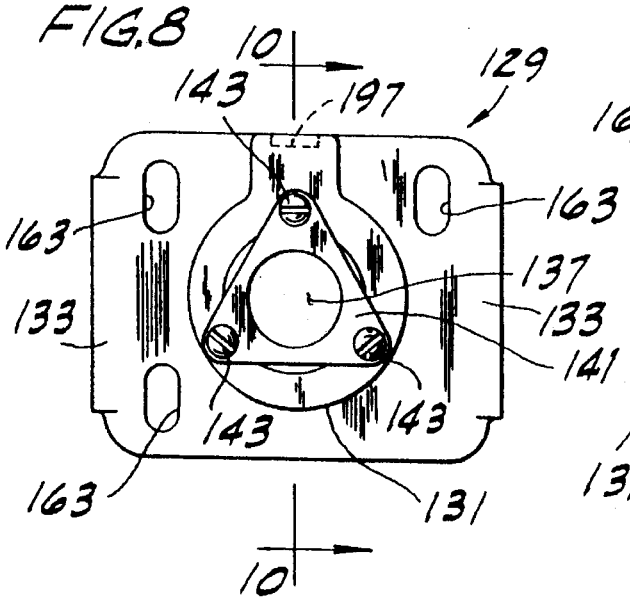
FIG. 8 is a front elevation of a bearing carrier and a bearing retainer mounted on the carrier.
Figure 9:
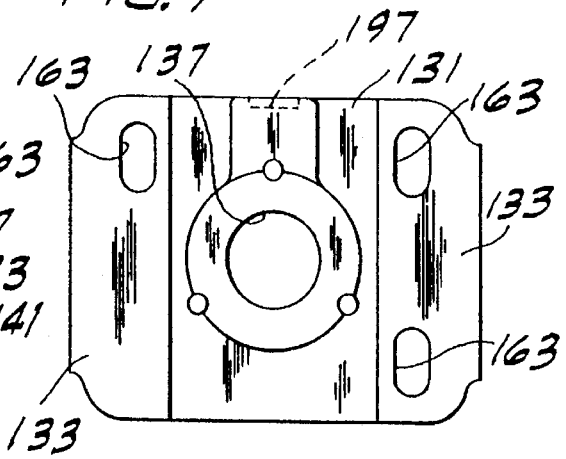
FIG. 9 is a rear elevation view of the bearing carrier of FIG. 8.
Figure 10:
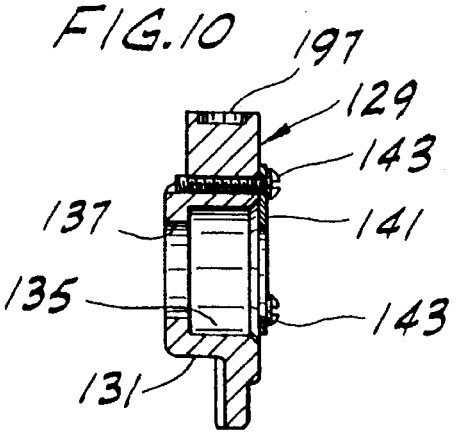
FIG. 10—10 is a sectional view along the plane of lines 10—10 of FIG. 8.
Figure 11:
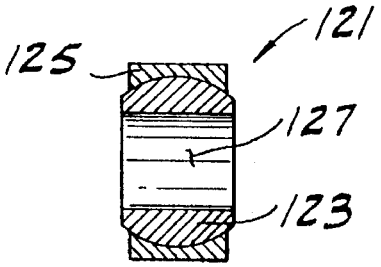
FIG. 11 is a sectional view of a bearing carried by the bearing carrier.

The truck frame 34 is shown in FIGS. 5 and 6. It includes a curved central member 70, the aforementioned elevated rear platform or caster/handle support 35 at the rearward end of the central member, and a pair of tubular journals 76, 78 projecting laterally from opposite sides of the central member adjacent its forward end. The journals 76, 78 define a bore 80 for receiving a pivot shaft 68 therethrough. The pivot shaft 68 can be fixed within bore 80 by suitable means such as by press-fit or through use of set screws. This shaft is often referred to as the "truck axle" of the sander. As will be described later in this specification, the chassis 22 is pivoted on the truck axle about axis A2 for moving between the aforesaid sanding and non-sanding positions. Extending forward from the left (as viewed from the front of the sander) truck axle journal 76 is a left arm 82 that terminates in a left truck wheel axle boss 84 defining a left truck wheel axle bore 86. Extending forward from the right truck journal 78 is a right arm 88 that terminates in a right truck wheel axle boss 90 defining a right truck wheel axle bore 92. Additionally, the central member 70 of the truck frame 34 has a flange 94 that projects laterally to one side of the frame (see FIGS. 6, 13, 14).

As best illustrated in FIG. 4, the left truck wheel **30*a* is rotatably mounted on a left truck wheel axle 96 disposed in the truck wheel axle bore 86 in the left truck wheel axle boss 84, and the right truck wheel 30*b* is rotatably mounted on a right truck wheel axle 98 disposed in the right truck wheel axle bore 92 in the right truck wheel axle boss 90. In accordance with an aspect of the present invention, the third truck wheel 30*c* is also mounted on the right truck wheel axle 98 a short distance and outboard from the right truck wheel 30*b*. The third truck wheel 30*c* adds greater stability to the sander 20** by enhancing the ability of the frame to bridge high and low areas of the floor being sanded, which results in a flatter finished surface.

FIG. 7 shows the chassis 22 of the sander. A dust tube mounting nipple 100 extends up from the back 24 of the chassis. The front 23 of the chassis defines a chamber 102 for enclosing the contact wheel 32, abrasive belt 64, and associated parts. An opening 104 is provided in the second side 26 of the chassis adjacent the chamber 102 for receiving the shaft/bearing assembly 72 and related parts (see FIG. 4). An opening 105 is also provided in the first side 25 of chassis for access to the contact wheel. This opening is closed by the hinged door 29 described previously. The chassis may be of cast metal.

In accordance with this invention, a first bearing assembly, generally designated 111, is provided on a first end of the pivot shaft 68, and a second bearing assembly, generally designated 113, is provided on a second opposite end of the pivot shaft. As explained in more detail below, the first side 25 of the chassis 22 is movable up and down relative to the first bearing assembly 111, while the second side 26 of the chassis is secured in substantially fixed vertical position with respect to the second bearing assembly 113. As a result, the cant of the chassis can be adjusted relative to the frame to "level" the sanding head 32 of the machine.

Figure 12:
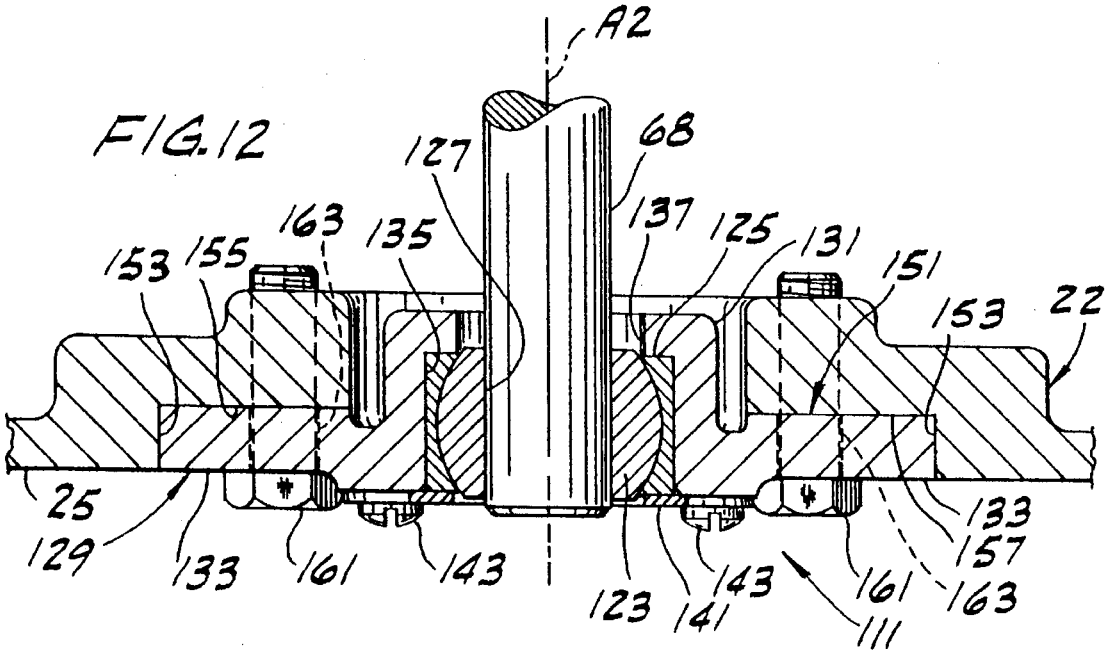
FIG. 12 is an enlarged sectional view along the plane of lines 12—12 of FIG. 1.

As shown in FIGS. 1 and 8–13, the first bearing assembly 111 includes a self-aligning bearing 121 comprising a ball 123 mounted in a sleeve 125. The sleeve 125 has an inner surface forming a socket which mounts the ball for universal movement of the ball relative to the sleeve. The ball has a diametric bore 127 through it for receiving the first end of the pivot shaft, as shown in FIG. 12. The bearing assembly 111 also includes a generally rectangular bearing carrier, generally designated 129, having a central portion 131 and opposite side portions 133. The central portion 131 is formed with a circular cup-like recess 135 which holds the bearing 121, the pivot shaft 68 extending through an opening 137 in the back wall of the central portion as shown in FIG. 12. The bearing 121 is held in the recess 135 by a retainer 141 which is fastened to the front face of the central portion 131 of the carrier 129 by screws indicated at 143.

The bearing carrier is mounted in a recessed area 151 in the first side 25 of the chassis 22 adjacent the bottom of the chassis. As best illustrated in FIGS. 7 and 12, this recessed area is in the shape of a vertical channel defined by a pair of vertical side edges 153 at opposite sides of the recessed area, and a pair of flat support surfaces lying in a common vertical plane between the vertical sides edges 153, the left side surface in FIG. 7 being designated 155 and the right side surface being designated 157. The side portions 133 of the bearing carrier 129 are engageable with the support surfaces 155, 157, and the support surfaces are spaced apart for receiving the central portion 131 of the bearing carrier therebetween, as shown in FIG. 12. The carrier 129 is secured to the chassis by one or more slotted connections (three are shown in the drawings), each of which comprises a bolt 161 or other suitable fastener extending through a vertical slot 163 in the carrier into a threaded opening 165 in the chassis 22. These connections allow up-and-down movement of the first side 25 of the chassis 22 relative to the first bearing assembly 111. These connections also function as stop means for limiting the range of this vertical movement. The lengths of the slots can be increased to permit a greater range of movement or decreased to permit a smaller range of movement.

The bearing carrier 129 preferably has a width only slightly less than the width of the channel-shaped recessed area 151 so that the recessed area functions as guideway to control the up and down movement of the left side 25 of the chassis relative to the first bearing assembly 111 and the frame 34 so that this movement is in a strictly vertical direction without any substantial movement of the left side 25 of the chassis forwardly or rearwardly as it moves up and down. This prevents the chassis 22 and the contact wheel 32 from becoming skewed in a horizontal plane relative to the axis A3 of the wheels **30*a*, 30*b*, 30*c* on the frame. Other types of guide systems can be used to control the up and down movement of the first side 25** of the chassis without departing from the scope of this invention.

The second bearing assembly 113 at the opposite end of the pivot shaft 68 also comprises a self-aligning bearing 171 comprising a ball 173 mounted in a sleeve 175 similar to that of the first bearing assembly 111 (FIG. 13). Relative movement between the pivot shaft and the ball and sleeve is prevented by a pair of snap rings, each designated 177, on the pivot shaft 68. The ball 173 and sleeve 175 are mounted in an opening 181 in the second side 26 of the chassis 22 (FIG. 7), the arrangement being such that the second side of the chassis is secured in substantially fixed vertical position with respect to the second bearing assembly 113. That is, unlike the first side 25 of the chassis which is movable up and down with respect to the first bearing assembly 111 and the first end of the pivot shaft 68, the second side 26 of the chassis cannot be moved up and down with respect to its respective bearing assembly 113 and respective end of the pivot shaft. The ball 173 and sleeve 175 are held against laterally outward movement relative to the chassis by a retainer indicated at 185 in FIGS. 13 and 14.

Figure 15:
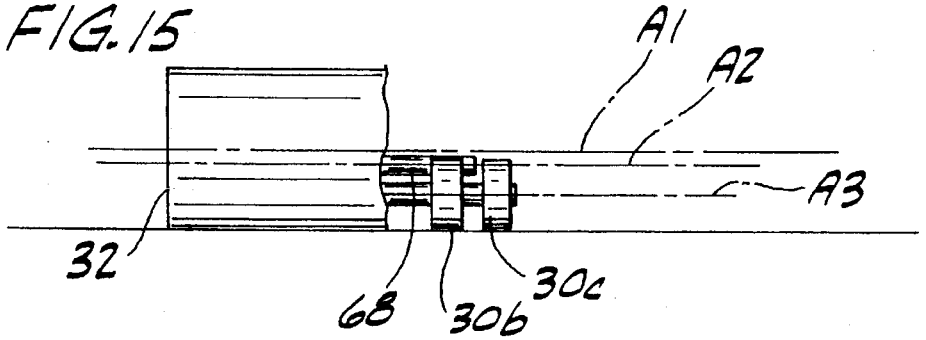
FIG. 15 is a schematic front view showing the orientation of the axis of the contact wheel relative to the axis of the frame wheels and the axis of the pivot shaft when the contact wheel is "level"

Referring now to FIGS. 13 and 14, a leveling mechanism means of the present invention is indicated generally at 191. It comprises an adjusting screw 193 operable to effect vertical movement of the first side 25 of the chassis 22 relative to the first bearing assembly 111 to adjust the attitude (cant) of the chassis to position the axis of rotation A1 of the contact wheel 32 in a plane common with the axis A3 of rotation of the wheels 30*a*, 30*b*, 30*c*. The adjusting screw 193 is threaded in a vertical tapped bore 195 in the chassis 22, and its lower end is receivable in a pocket or depression 197 in the top of the bearing carrier 129. Rotation of the screw in one direction lifts the first side 25 of the chassis relative to the first bearing assembly 111 and the frame toward the position shown in FIGS. 13 and 13A, and rotation of the screw in the opposite direction causes the first side of the chassis to move down under its own weight and the weight of the motor 27 toward the position shown in FIGS. 14 and 14A. Since the second side 26 of the chassis is fixed vertically, the up and down movement of the first side 25 of the chassis is a pivotal movement about an axis A4 (FIG. 4) extending in front-to-back direction with respect to the chassis 22, the second end of the pivot shaft 68 and second bearing 171 serving as the fulcrum for such pivotal movement. FIGS. 13, 13A and 14, 14A illustrate the two extremes of this movement, FIGS. 13 and 13A showing the axis A1 of the contact wheel 32 skewed in a vertical plane in one direction with respect to the axis A3 of the frame wheels and the axis A2 of the pivot shaft 68, and FIGS. 14 and 14A showing the axis A1 of the contact wheel skewed in a vertical plane in the opposite direction with respect to the axis A3 of the frame wheels and the axis A2 of the pivot shaft. Between these two extremes is the desired position (FIG. 15) where the axis of the contact wheel is "level" (coplanar) with the axis of the wheels and also "level" with the axis of the pivot shaft. The angular range of adjustment of the contact wheel 32 between the two extreme positions shown in FIGS. 13, 13A and 14, 14A is preferably about 2.37 degrees. In the embodiment shown in the drawings, the limits of this range are established by the lengths of the slots 163 in the bearing carrier 129, but it will be understood that these limits can be set in other ways. Also, means other than screw 193 may be used for effecting the necessary relative vertical movement between the first side 25 of the chassis 22 and the bearing carrier 129. The specific mechanism used for effecting this relative movement is not critical; what is important is that such vertical movement be strictly controlled by a guide system (e.g., the guideway formed by the channel shaped recess 151 in the chassis) so that there is no forward and rearward movement of the first side of the chassis relative to the second side of the chassis during the adjustment process.

Figure 16:
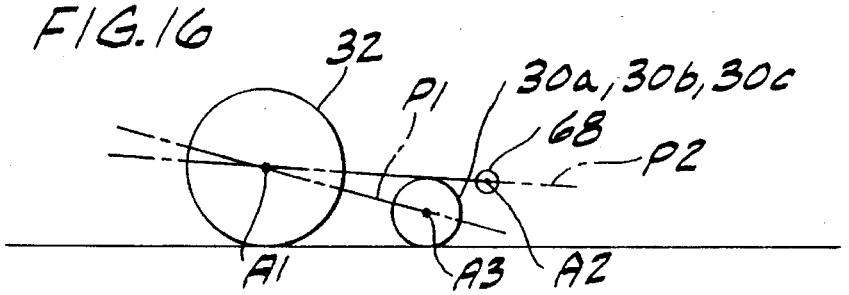
FIG. 16 is a schematic side view showing the various positions of the contact wheel, frame wheels and pivot shaft relation to one another.

As noted above, when the contact wheel 32 is "level", its axis A1 of rotation lies in a plane common with the axis A3 of the wheels 30*a*, 30*b*, 30*c* on the frame 34, and in a plan common with the axis A2 of the pivot shaft 68. These planes are indicated at P1 and P2, respectively, in FIG. 16. In the preferred embodiment, the axis A1 of rotation of the contact wheel 32 is disposed at an elevation higher than the axis A2 of the pivot shaft 68 when the contact wheel is in engagement with the surface to be sanded. This configuration tends to more effectively maintain the contact wheel in continuous engagement with the floor during sanding process to provide a smoother finish to the surface. It will be understood, however, that the relative elevations of axes A1, A2 and A3 can be varied with respect to one another without departing from the scope of this invention. It will also be understood that the number of wheels on the frame may vary. For example, instead of three wheels 30*a*, 30*b* and 30*c*, two wheels could be used. Moreover, the wheels could be rotatable on different horizontal axes extending in side-to-side direction with respect to the frame 34. In this situation, the contact wheel 32 would be considered to be "level" if its axis A1 is coplanar with each of the wheel axes.

Referring again to FIGS. 13 and 14, the sanding pressure exerted by the contact wheel 32 is regulated by a three position lever 201 mounted on the chassis 22, and a tension spring 203 connected at its upper end to the lever 201 and at its lower end to the flange 94 on the frame 34. By positioning the lever 201 in the various positions, the downward force exerted by the spring on the chassis (and thus the contact wheel 32) can be varied to adjust the sanding pressure applied by the sander.

It will be observed from the foregoing that a sander of the present invention represents a significant improvement over prior designs. The leveling mechanism 191 is quickly and easily operable simply by turning the adjustment screw 193 to bring the chassis 22 and the contact wheel 32 into a position in which the contact wheel is "level" with the frame wheels, that is, to a position in which the axis A1 of rotation of the contact wheel is in a plane (e.g., P1) common with the axis A3 of the frame wheels. This leveling is accomplished by using a guide system means which controls the movement of the chassis so that it moves only vertically and not forward or rearward, thus avoiding any skewing of the sanding head 32 in a horizontal plane and the various problems associated therewith, including straining of the abrasive alignment components, uneven wheel wear and sideward tracking of the sander. Moreover, since both the sanding head 32 and drive motor 27 are mounted on the chassis 22, leveling does not affect alignment of the drive belts and other drive components, and rigidity of the sanding head is maintained. Most importantly, the leveling system 191 maintains the sanding head 32 level with respect to the wheels 30*a*, 30*b*, 30*c* as the wheels move across the sanding surface, thereby providing a more uniform, smoother, higher quality floor finish. Also, since the sanding head 32 is mounted on the chassis 22 and not on the frame 34, the sanding force exerted by the sanding head is not significantly affected by forces applied to the handle 46 of the sander as it is pushed and pulled across a floor, or by movement of the caster assembly 36 as it swivels back and forth during changes in direction.

The leveling mechanism of the present invention can be used not only for continuous belt sanders, but also for drum sanders.

While the foregoing is directed to the preferred embodiment of the present invention, other and further embodiments of the invention may be devised without departing from the basic scope thereof, and the scope thereof is determined by the claims which follow.

What is claimed is:

1. A floor sander comprising:

a frame on wheels, at least one of said wheels being rotatable about a wheel axis extending in side-to-side direction with respect to the frame, a chassis carried by the frame, said chassis having a front, a back, a first side, and a second side opposite the first side, a motor-driven sanding head mounted on the chassis generally adjacent the front of the chassis for rotation about an axis extending in side-to-side direction with respect to the chassis and with respect to the frame, a pivot shaft mounted on the frame and extending in side-to-side direction with respect to the frame, said chassis being pivotable on the pivot shaft to raise and lower the sanding head relative to a surface to be sanded, a first bearing assembly on a first end of the pivot shaft adjacent the first side of the chassis, the first side of the chassis being movable up and down relative to said first bearing assembly, a guide means for controlling the up and down movement of the first side of the chassis relative to the first bearing assembly so that said movement is in a vertical direction, a second bearing assembly on a second end of the pivot shaft, the second side of the chassis being secured in substantially fixed vertical position with respect to the second bearing assembly, and a leveling means operable to effect vertical movement of the first Side of the chassis relative to the first bearing assembly and with respect to the second side of the chassis thereby to adjust the attitude of the chassis to position the axis of rotation of the sanding head in a plane common with said wheel axis.

2. A floor sander as set forth in claim 1 wherein said bending means is operable to pivot the chassis generally on the second end of the pivot shaft about a pivot axis extending in front-to-back direction with respect to the chassis.

3. A floor sander as set forth in claim 2 wherein said guide means comprises a vertical guideway in the first side of the chassis, said first bearing assembly being slidably engageable with said guideway when the first side of the chassis is moved up and down relative to the first bearing assembly.

4. A floor sander as set forth in claim 3 further comprising stop means for limiting the range of vertical movement of the first side of the chassis relative to said first bearing means.

5. A floor sander as set forth in claim 4 wherein said stop means comprises one or more slotted connections between the first bearing assembly and the first side of the chassis.

6. A floor sander as set forth in claim 2 wherein each of said first and second bearing assemblies comprises a self-aligning bearing.

7. A floor sander as set forth in claim 1 wherein the axis of rotation of the sanding head is disposed at an elevation higher than that of said pivot shaft when the sanding head is in contact with said surface to be sanded.

8. A floor sander as set forth in claim 1 wherein said leveling means comprises a screw threaded in a bore in the chassis and engageable with said first bearing assembly whereby threading the screw in one direction raises said first side of the chassis relative to the bearing assembly and frame, and threading the screw in an opposite direction lowers the first side of the chassis relative to the bearing assembly and frame.

9. A floor sander as set forth in claim 1 wherein said frame wheels comprise at least two wheels mounted on the frame of the sander for rotation about said wheel axis, said wheel axis being located forward of said pivot axis.

10. A floor sander as set forth in claim 9 further comprising a third frame wheel mounted on the frame generally coaxial with said two frame wheels.

11. A floor sander as set forth in claim 1 wherein said floor sander is a continuous belt sander and wherein said sanding head comprises a contact wheel generally adjacent the front of the chassis, and a continuous sanding belt trained around the contact wheel and a tracking roller.

* * * * *

UNITED STATES PATENT AND TRADEMARK OFFICE

CERTIFICATE OF CORRECTION

PATENT NO. : 5,575,710

DATED : November 19, 1996

INVENTOR(S) : Michael G. Kramer

It is certified that error appears in the above-identified patent and that said Letters Patent is hereby corrected as shown below:

Column 9, claim 1, line 21, "first Side" should read ---first side---.

Column 9, claim 2, line 28, "bending means" should read ---leveling means---.

Signed and Sealed this

Sixth Day of May, 1997

*Attest:*

*Attesting Officer*

BRUCE LEHMAN

*Commissioner of Patents and Trademarks*